US005730635A

United States Patent [19]

De Haas et al.

[11] Patent Number: 5,730,635

[45] Date of Patent: Mar. 24, 1998

[54] METHOD OF PROVIDING A PATTERN OF APERTURES AND/OR CAVITIES IN A PLATE OF NON-METALLIC MATERIAL

[75] Inventors: Franciscus C. M. De Haas; Franciscus M. H. Van Laarhoven; Johannus M. E. Van Laarhoven; Henricus J. Ligthart; Petrus H. W. Swinkels; Johannes G. Van Beek, all of Eindhoven, Netherlands

[73] Assignee: U.S. Philips Corporation, New York, N.Y.

[21] Appl. No.: 481,529

[22] PCT Filed: Nov. 8, 1994

[86] PCT No.: PCT/NL94/00277

§ 371 Date: Jul. 7, 1995

§ 102(e) Date: Jul. 7, 1995

[87] PCT Pub. No.: WO95/13623

PCT Pub. Date: May 18, 1995

[30] Foreign Application Priority Data

Nov. 9, 1993 [BE] Belgium ..... 09301236

[51] Int. Cl.[6] ..... H01J 9/00; H01J 1/90

[52] U.S. Cl. ..... 445/24; 451/29

[58] Field of Search ..... 445/24; 451/29, 451/30

[56] References Cited

U.S. PATENT DOCUMENTS

| | | | |
|---|---|---|---|
| 2,277,937 | 3/1942 | Shryer et al. | 451/29 |
| 3,993,708 | 11/1976 | Brinkmann et al. | 260/830 P |
| 4,013,806 | 3/1977 | Volkert et al. | 451/54 |
| 4,388,550 | 6/1983 | de Vries | 313/585 |
| 4,898,557 | 2/1990 | Engemann | 445/24 X |
| 5,197,234 | 3/1993 | Gillenwater | 451/29 |
| 5,347,201 | 9/1994 | Liang et al. | 313/309 X |

FOREIGN PATENT DOCUMENTS 562670 9/1993 European Pat. Off. .

*Primary Examiner*—Kenneth J. Ramsey
*Attorney, Agent, or Firm*—Robert J. Kraus

[57] ABSTRACT

A method of providing a plurality of cavities and/or apertures in a plate or layer wherein, after the plate or layer has been provided with a mask having a plurality of apertures arranged in a pattern, at least one jet of abrasive powder particles is moved relative to the plate. On its exposed surface, the mask is provided with a coating which prevents substantial mechanical stresses from being generated in the mask during the process by the jet of powder particles.

11 Claims, 5 Drawing Sheets

METHOD OF PROVIDING A PATTERN OF APERTURES AND/OR CAVITIES IN A PLATE OF NON-METALLIC MATERIAL

BACKGROUND OF THE INVENTION

The invention relates to a method of providing a plurality of cavities and/or apertures arranged in a pattern in a plate or layer of non-metallic material.

Plates or layers of this patterned type of non-metallic, particularly hard, brittle materials such as glass, oxidic or ceramic material, are particularly used in microelectronic devices such as electro-luminescent gas discharge displays (for example, plasma displays), in field emission displays, cathode ray displays and in displays in which electrons are propagated in ducts having walls of electrically insulating material (referred to as insulating electron duct displays) in which the apertures or cavities are used for manipulating electron currents. They may be formed as (multi-apertured) control plates and provided with (addressable) electrodes cooperating with the apertures, as transport plates having a plurality of parallel cavities (transport ducts), or as apertured spacers (for example, between a control plate and the luminescent screen of a luminescent display).

U.S. Pat. No. 4,388,550 describes a luminescent gas discharge display. This display requires a control plate controlling the individual pixels. This control plate divides the inner space of such displays into two areas, a plasma area and a post-acceleration area. It comprises a "perforated" plate having an array of lines at one side and at the other side an array of columns of metal conductors or electrodes surrounding or extending along the perforations. These enable electrons to be selectively extracted from the plasma area through the apertures to the post-acceleration area and to be incident on the luminescent screen. Other gas discharge displays comprise, for example plates having (facing) cavities.

In a control plate, the number of perforations or apertures in a plate of the type described above is defined by the number of desired pixels.

Present-day television line scan patterns use, for example approximately 500×700 pixels having a horizontal pitch of 0.5 mm and a vertical pitch of 0.7 mm. These pixels define the pattern of apertures to be provided in the control plate of electrically insulating material.

It is known from EP 0 562 670 that these patterns can be manufactured by means of an apertured mask and a powder spray process. This process is possible by virtue of the large difference in production rate between the mask material and the material of the object which is to be provided with a pattern of apertures (particularly glass). A problem which appears to occur when a separate (metal) mask is used is, however, that the desired accuracies are not always achieved. The invention is based, inter alia, on the recognition that the mask may assume a convex shape during spraying, inter alia, with the result that it is no longer seated correctly on the product to be provided with a pattern, which is at the expense of the accuracy of this pattern. And that deformation may occur, even when a convex shape does not occur, or will occur to a minor extent, if a very good adhesion is ensured. A change of the absolute dimensions of the mask due to deformation does not only lead to inaccuracies in the pattern but also renders it unsuitable for repeated use.

SUMMARY OF THE INVENTION

It is an object of the invention to provide a (preferably simple) method which mitigates the above-mentioned problems.

The method according to the invention is therefore characterized in that the pattern is made by means of the following steps:

producing at least one jet of abrasive powder particles;

directing the jet onto a surface of the plate or layer;

limiting the areas where the jet impinges upon the surface;

performing a relative movement between the jet and the plate or layer, using a mask for limiting the areas where the jet impinges upon the surface, which mask has its surface on which the jet impinges coated with a layer preventing substantial mechanical (pressure) stresses from being generated in the mask during the process by the jet of powder particles.

The invention is based on the recognition that the deformation, or warping, is due to the fact that spraying the mask with the powder particles leads to a build-up of stresses, and that this problem can be reduced to a considerable extent if a layer is provided on the mask which is sufficiently thick and elastic. Many lacquers can only be provided in the form of a thin layer, are too hard or adhere too poorly to (continue to) fulfil the desired function during the process. Suitable materials are, for example soft elastic (plastically deformable but tough) lacquer types, particularly soft-touch lacquers. Soft-touch lacquers are soft and warm to the touch and are used, for example, for coating metal objects (shavers, car steering wheels). These may be, for example polyurethane-like lacquers, polyurethane or epoxy-based lacquers. They may be_simply provided in advance on the mask by means of spraying. The coating should be thick and elastic enough so as not to pass on substantial stresses the mask. In many cases this means that the coating should have at least a thickness-which corresponds to the size of the powder particles. When powder particles having a size of, for example 20 to 25 microns are used, a thickness of approximately 20 to 25 microns is thus necessary. If accurate patterns are to be obtained, the thickness of the mask plus the coating should not become too large. Generally this means that the coating does not exceed a thickness of 100 microns.

It is important that said coating is sufficiently resistant to the powder spraying process so that it will be effective until the end of the process. Soft-touch lacquers appear to have this resistance to a certain extent. The use of a (top) coating having a sticky surface provides additional advantages, because the powder particles used during the powder spraying process will then stick in the sticky surface and provide extra protection, which contributes to the lifetime. For example, photoadhesive and other sticky adhesives are suitable for this purpose.

Instead of being provided on a separate mask, the aforementioned jet-resistant soft elastic lacquers types may be directly provided on the object to be patterned and serve as a mask after patterning.

The use of a perforated (particularly metal) plate as a mask is found to be very suitable. By using the invention, the sizes are maintained and the mask can be used several times. If necessary, the coating may be repaired or renewed before the mask is used again.

When a separate metal or synthetic material plate is used as a mask, it is advantageous to stick this mask to the plate to be sprayed. An easily removable adhesive can be used for this purpose (for example, glucose-based adhesives can easily be removed with water). Since the invention leads to less warping, less large "adhering" forces are required and it will be better possible to use a plate of a magnetizable metal, for example Fe, for the mask and to "stick" this plate to the plate to be sprayed by means of a magnetic field generated by "magnetic clamps" at the other side of the plate to be sprayed.

Satisfactory sticking is important to maximally prevent the mask from being locally detached during spraying, causing powder particles to come underneath the mask and possibly damage the parts not to be sprayed (referred to as underspraying).

The adhesive strength of the coating may sometimes be insufficient so that build-up of mechanical stresses in the mask may still occur. By providing the mask at its side to be coated with an adhesive primer (lacquer primer) in advance, the adhesive strength of the coating is enhanced.

BRIEF DESCRIPTION OF THE DRAWINGS

These and other aspects of the invention will be apparent from and elucidated with reference to the embodiments described hereinafter.

In the-drawings

DETAILED DESCRIPTION OF THE PREFERRED EMBODIMENTS

Electrically insulating control plates, transport plates and/or spacer plates having very accurate patterns of apertures and/or cavities are required for use in different types of (electroluminescent) displays. The plate thickness may be between 50 and 5000 microns, particularly between 50 and 700 microns. A characteristic material for these applications is glass or ceramic material.

Figure 1:
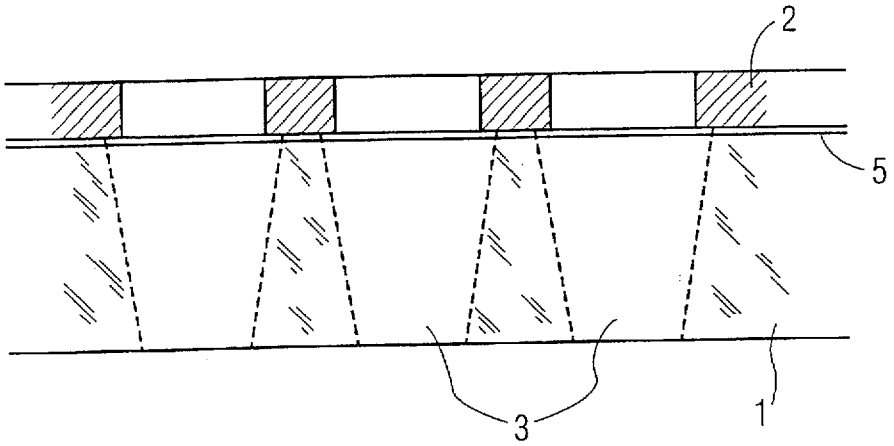
FIG. 1 is a cross-sectional view of a plate provided with a perforated mask.

FIG. 1 is a cross-sectional view of such a plate 1 provided with a metal mask 2. Suitable metals are those which are easily etchable, such as Fe and Fe alloys. They preferably exhibit little tendency to build up mechanical stresses ("shot peening") when spraying with powder particles. In this respect, Akoca is a suitable material. However, the invention provides a wider choice of materials to be used. Instead of a metal mask, a lacquer mask (for example, of a lacquer used in the silk screening technique) or a synthetic material mask (for example, of an UV-sensitive synthetic material) may be used.

Figure 2:
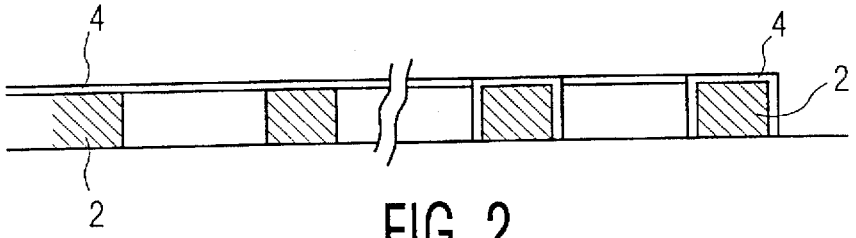
FIG. 2 shows cross-sectional views of two perforated masks provided with a coating.

The mask 2 is provided, for example, by means of one or more spraying steps with a coating 4 (FIG. 2) of a layer preventing shot-peening such as particularly a soft-touch lacquer and/or a sticky adhesive according to the invention. The coating 4 can only coat the surface of the mask 2 (at the left in FIG. 2) or also the walls of the apertures (at the right in FIG. 2). A layer of adhesive primer may be present between the coating 4 and the mask 2. A separate mask may be stuck on the plate 1 by means of an adhesive layer 5 so as to inhibit local detaching during the powder spraying process. The adhesive layer 5 may comprise an adhesive which is soluble in water (for example, an adhesive based on glucose). Such an adhesive can be easily provided at low cost and simply removed after use. (The mask 2 may be alternatively made of a magnetic material and "stuck" to the plate 1 by means of a magnetic field.)

To improve the step of gluing the mask by means of glucose or another adhesive on a plate to be provided with a pattern, also the side of the mask to be glued may be provided in advance with the adhesive primer (lacquer primer). The mask will then be better prevented from being detached from the plate during the powder spraying process (due to the mechanical tensions building up in the mask).

The apertures 3 denoted by broken lines in the plate 1 are slightly tapered in the embodiment of FIG. 1. When plates are used as internal vacuum supports (spacer plates) in field emission displays, such an aperture shape is not unusual. However, it is alternatively possible to make substantially cylindrical apertures or cavities with substantially parallel walls. Plates having cylindrical apertures are suitable, for example, as spacers between a control plate and the luminescent screen in an insulating electron duct display.

Figure 3:
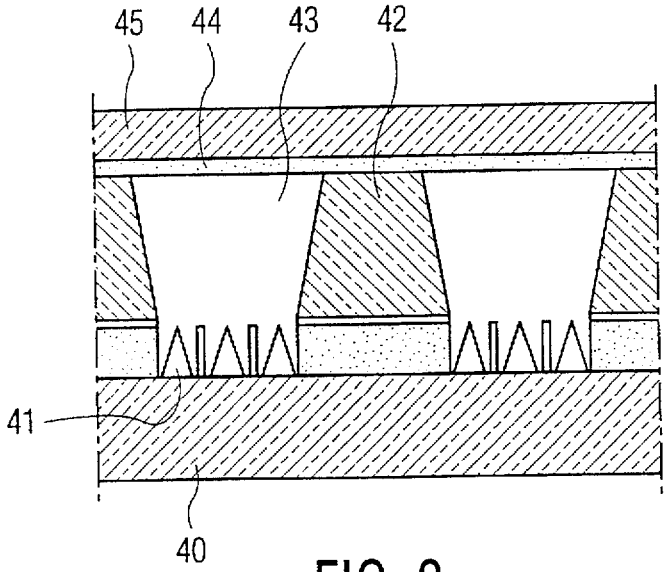
FIG. 3 is a cross-sectional view of a field emission display.

FIG. 3 is a diagrammatic cross-sectional view of a field emission display comprising a substrate 40, conical emission tips 41, a spacer plate 42 with apertures 43 and a front wall 45 with a luminescent screen 44. The spacer plate 42 may advantageously be made by means of the method according to the invention.

Figure 4A:
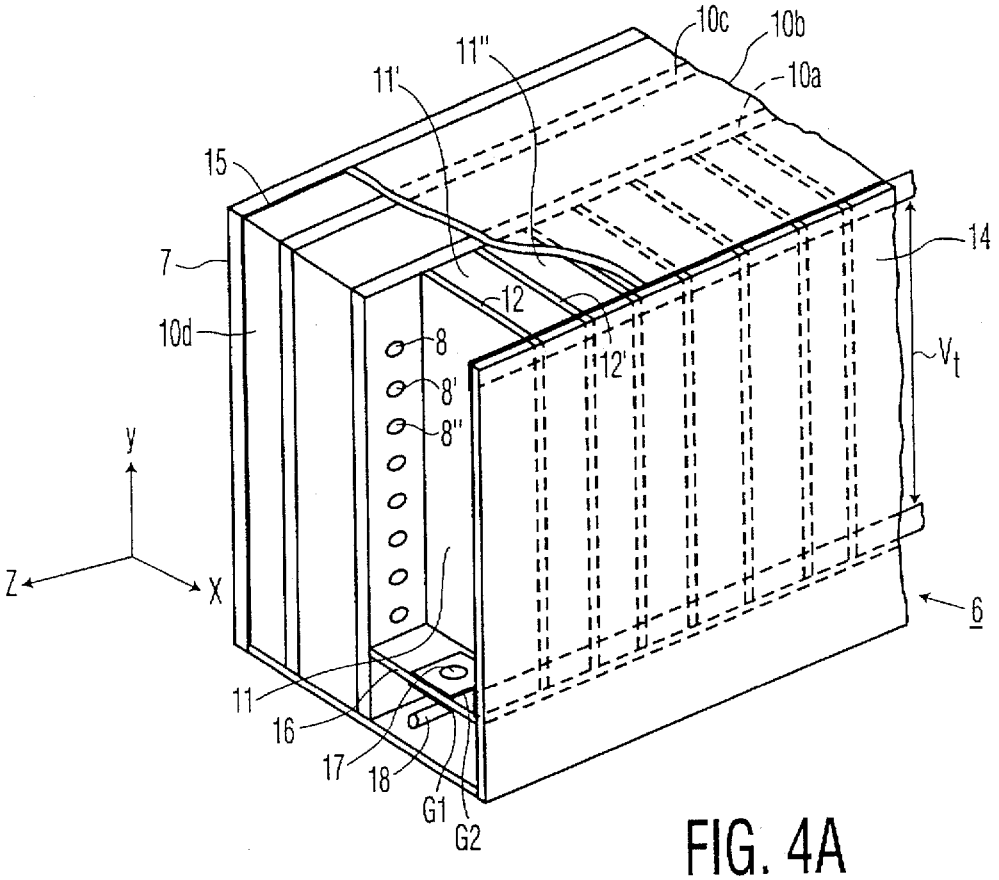
FIG. 4*a* is an elevational view.
Figure 4B:
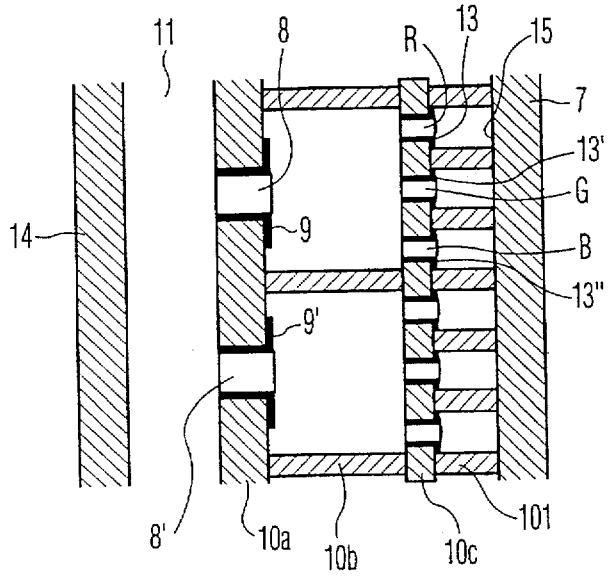
FIG. 4*b* is a cross-sectional view of an insulating electron duct display.

FIG. 4*a* is a diagrammatic elevational view and FIG. 4*b* is a cross-sectional view of an insulating electron duct display 6 as described in EP-A-400 750. This display comprises a plurality of insulator plates 10*a*, 10*b*, 10*c*, 10*d* having regular aperture patterns between a transparent face plate 7 and a rear wall 14.

A luminescent screen 15 is provided on the inner surface of the face plate 7. A (glass) flu-spacer plate 10*d* having a characteristic thickness of between approximately 0.4 and 1 mm and, for example $1\times10^6$ apertures corresponding to the number of luminescent areas (colour dots) on the screen 15 is adjacent to this luminescent screen. The colour dots are addressed by means of a preselection plate 10*a* and a fine-selection plate 10*c* each of, for example glass and being 0.5 mm thick. The plate 10*c* has a pattern of aperture triplets R, G, B in this case. The apertures in the plate 10*c* are activated, for example row by row by means of metal fine-selection electrodes 13, 13', 13", . . . These electrodes may be provided after the apertures have been made, which provides the possibility of metallizing the walls of the apertures as well. An alternative method is to provide the fine-selection electrodes in advance. Preselection plate 10*a* is separated from fine-selection plate 10*e* by a spacer structure 10*b*, in this case a plate having (large) apertures connecting each one of, for example 350,000 apertures 8, 8', . . . in the preselection plate 10*a* to a plurality of apertures in the fine-selection plate 10*c*. The preselection plate 10*a* is provided with preselection electrodes 9, 9', . . . for activating, for example row by row, the apertures 8, 8', . . . communicating with electron transport ducts 11, 11', 11", . . . (see also FIG. 4*a*). The transport ducts 11, 11', 11", . . . are separated from each other in this case by electrically insulating partitions 12, 12', 12", . . . An alternative method is to provide the transport ducts (a total number of several hundred, for example 200 or 400) as duct-shaped cavities having a depth of several mm and a width of, for example 0.5 or 1 mm in the rear wall 14. The method according to the invention is also applicable for this purpose. The rear wall 14 constitutes an electron transport plate in this case. The transport ducts 11, 11', 11", . . . cooperate, via a perforated cathode plate 16 (of, for example 1 mm thick glass) with a—line-shaped—electron source 18. The apertures 17 in the cathode plate 16 (also several hundred, for example 200 or 400) may also be provided advantageously by means of the method according to the invention.

Inter alia, in connection with the very large numbers of apertures, deformation and/or detaching from the mask is very undesirable and the invention provides a solution in the manufacture on an industrial scale.

Figure 5:
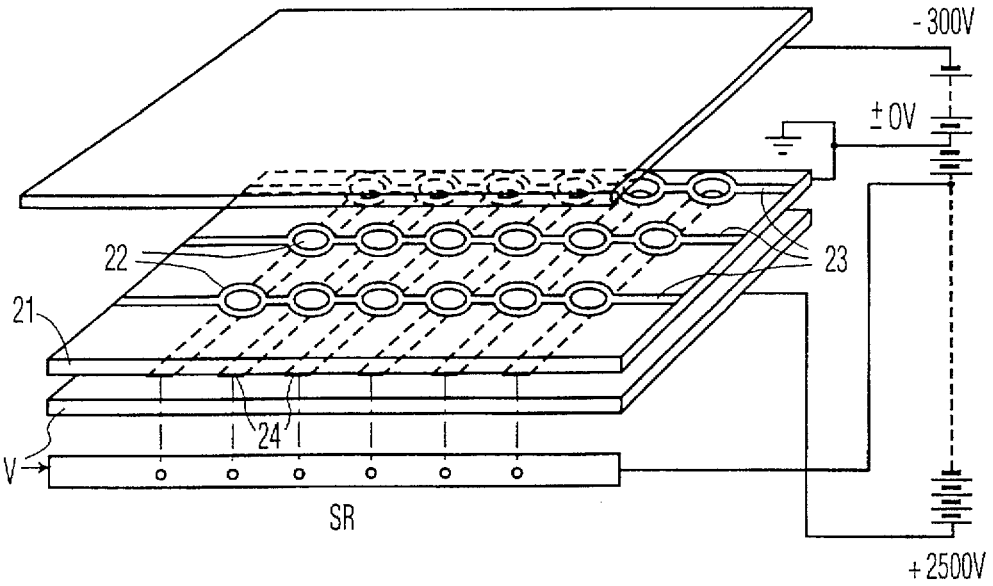
FIG. 5 is a cross-sectional view of a gas discharge display.

FIG. 5 is a diagrammatic elevational view of a gas discharge display as described in DE-2 412 869. This display has an insulator plate 21 provided with a regular pattern of apertures 22. Row conductors 23 extend at one side across the apertures 22. These conductors are provided by means of, for example a printing technique, vapour deposition or photolithography. Column conductors 24 extend across the other side of the apertures 22. DE-2 412 869 is referred to for the operation of such a display. The insulator plate 21 may advantageously be made by means of the method according to the invention.

Figure 6:
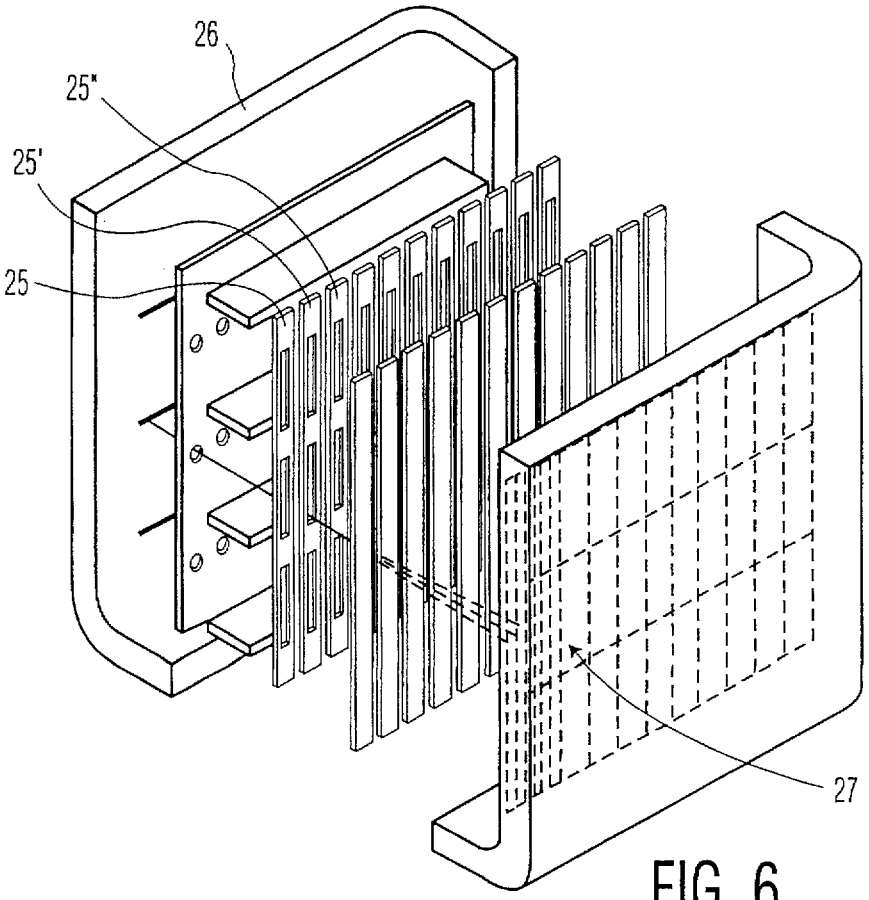
FIG. 6 is an exploded view of a flat panel display.

FIG. 6 is a diagrammatic elevational view of a flat panel display of the beam matrix type. This display comprises a large number of metal electron beam control electrodes 25, 25', 25", . . . provided with slotted apertures between a rear wall 26 and a luminescent screen 27. By providing these electrodes on a plate of electrically insulating material having the same aperture pattern, advantages as regards ease of handling and suspension can be realised.

Figure 7:
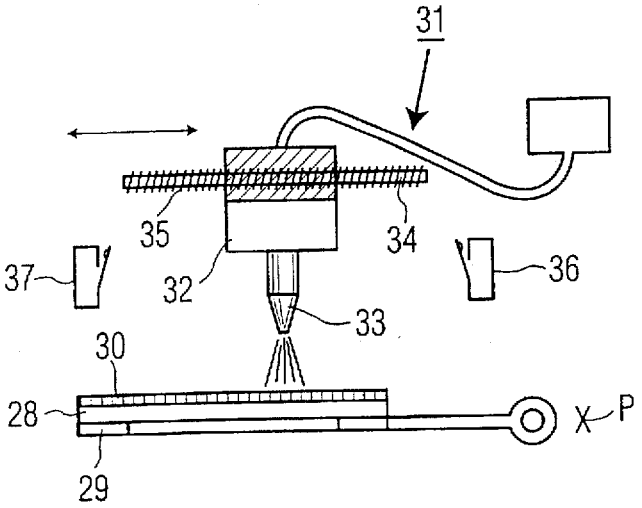
FIGS. 7 and 8 show diagrammatically how a pattern of apertures is provided in a plate by means of a powder spraying device.
Figure 8:
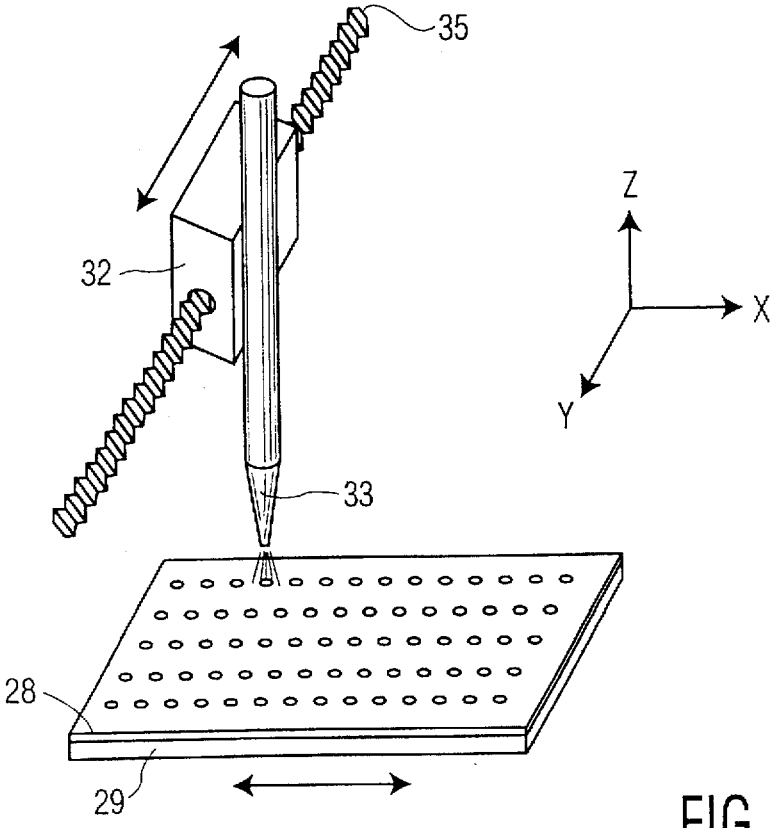

FIG. 7 shows a plate 28 to be sprayed, which plate is positioned on a support 29. The support 29 is movable in the direction of the arrow P perpendicular to the plane of the drawing. The plate 28 is provided with a mask 30 having the shape of a perforated metal plate. In this example, the mask 30 has a regular pattern of circular apertures (see FIG. 8). A device 31 for performing an abrasive operation (powder spraying device) is shown diagrammatically as a spraying unit 32 having a nozzle 33 directed onto the surface of the plate 28. Dependent on, for example, whether apertures or cavities are to be made, the nozzle/mask distance may range between 0.5 and 25 cm, typically between 2 and 5 cm. During operation a jet of abrasive powder particles, for example silicon carbide particles, aluminium oxide particles, granulated glass, granulated steel or mixtures thereof is blown from the nozzle 33. A pressure principle or a venturi principle may be used for this purpose. Abrasive particle dimensions suitable for the object of the invention range between 1 and 200 microns, typically between 10 and 100 microns.

In this embodiment spraying unit 32 with nozzle 33 can be traversed in a direction transverse to the arrow P by means of a traversing device 34 which has a spindle 35, but other ways of motion are alternatively applicable.

Stops provided with electric contacts are denoted by the reference numerals 36 and 37 and are assumed to be connected to a reversing circuit so as to reverse the sense of rotation of the spindle 35 to be driven by a motor.

During operation, the support 29 and the plate 28 make a, for example reciprocating movement parallel to the X axis and the spraying unit 32 performs axial traversing movements parallel to the Y axis (FIG. 8), the speeds of movement being adapted to each other in such a way that the complete desired aperture or cavity pattern is obtained in the plate 28. Instead of one nozzle, it is possible (for example, for the purpose of accelerating the process, but particularly for a better homogeneity of the desired pattern) to use a number of nozzles. This number may be 6, but may alternatively be 100. For a good homogeneity it is useful that each nozzle is moved across each piece of the mask.

A 0.5 mm thick plate of 30×40 cm can be provided with a very accurate aperture pattern of $1\times10^6$ apertures having a diameter of 600 microns, for example within 1 minute in the manner described above.

For insulating electron duct displays of the type shown in FIG. 4, perforated plates with aperture patterns having a number of apertures varying between $100\times 10^3$ and $10\times10^6$ are required.

The invention may alternatively be used for providing a large number of parallel elongate cavities in a plate of electrically insulating material, which cavities are used as electron transport ducts in an insulating electron duct display. The display shown in FIG. 4*a* comprises several hundred (for example, 400) of such electron transport duct cavities 11, 11', 11", . . . etc.

If the powder spraying process can be performed in such a way that there is a minimal deformation of the masks, it will be attractive to provide the masks with an additional pattern of apertures for forming aligning means in the plate to be treated. This pattern may be provided in the mask simultaneously with the pattern of apertures by way of a photolithographic process. Due to the stencil effect of the powder spraying process, the accuracy of the position of the aligning means with respect to the pattern of apertures in the plate to be treated is determined with photolithographic accuracy. The aligning means may be a mark, or a positioning means.

Figure 9:
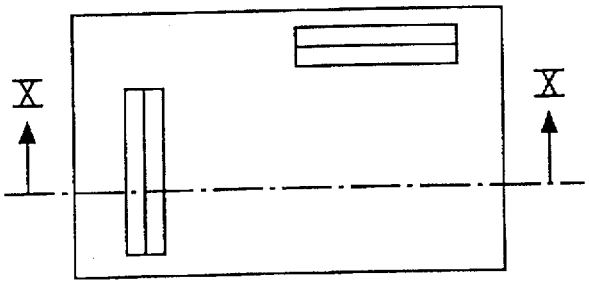
FIGS. 9, 10, 11, 12 and 13 show views of an embodiment of the invention.
Figure 10:
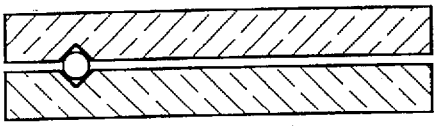
Figure 11A:
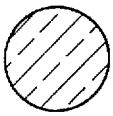
Figure 11B:
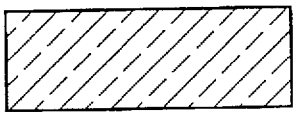
Figure 12A:
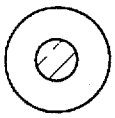
Figure 12B:
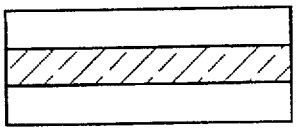
Figure 13A:
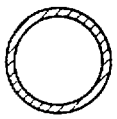
Figure 13B:
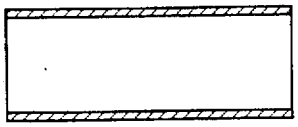

An embodiment in which the above-mentioned effect is utilized is an additional pattern of apertures in the form of a line-shaped slit. This produces a V-shaped groove in the underlying plate during the powder spraying process (FIG. 9). By placing a cylindrical body in the groove on which a plate provided with a countergroove is positioned, two plates can be aligned accurately with respect to each other (FIG. 10). The cylindrical body may be, for example a solid fibre (FIG. 11), a solid fibre having a resilient, shrinking or elastic outer cladding (FIG. 12) or a resilient metal tube (FIG. 13). By means of the method according to the invention, alignment marks (for example, grounded surfaces, crossing grooves, concentric grooves) may be provided in the plate to be treated, which grooves are used for optically aligning the plate.

A further advantage of the use of a coating comprising a-material which does not pass on, or hardly passes on the impact energy of the powder particles to the mask is that relatively thin mask material may be used without the risk of convexity or deformation. (This means that thicknesses ranging between 100 and 250 μ and located closer to 100 μ than to 250 μ will be usable. Normally it holds that there will be less deformation as the thickness of the material is larger.) This provides the possibility of smaller geometries of the aperture pattern. Another advantage is that the abrasive powder wears less rapidly.

What is claimed is:

1. A method of providing a plurality of cavities and/or apertures arranged in a pattern in a plate or layer of non-metallic material in which the pattern is made by means of the following steps:

producing at least one jet of abrasive powder particles;

directing the jet onto a surface of the plate or layer;

limiting the areas where the jet impinges upon the surface;

performing a relative movement between the jet and the plate or layer, using a mask for limiting the areas where the jet impinges upon the surface, which mask has its surface on which the jet impinges coated with a layer preventing substantial mechanical stresses from being generated in the mask during the process by the jet powder particles, wherein the coating comprises a polyurethane-based or epoxy-based lacquer and has a sticky surface.

2. A method as claimed in claim 1, characterized in that the mask side to be coated is provided with an adhesive primer in advance.

3. A method of providing a plurality of cavities and/or apertures arranged in a pattern in a plate of non-metallic material, in which the pattern is made by means of the following steps:

producing at least one jet of abrasive powder particles;

directing the jet onto a surface of the plate:

limiting the areas where the jet impinges upon the surface;

performing a relative movement between the jet and the plate, using a mask provided with a pattern of apertures for limiting the areas where the jet impinges upon the surface, the mask being provided with an additional pattern of apertures for forming at least one aligning means in the plate; and providing at least one groove as a positioning means in the plate by means of the additional pattern of apertures.

4. A method of providing a plurality of cavities and/or apertures arranged in a pattern in a plate or layer of non-metallic material in which the pattern is made by means of the following steps:

producing at least one jet of abrasive powder particles:

directing the jet onto a surface of the plate or layer;

limiting the areas where the jet impinges upon the surface;

performing a relative movement between the jet and the plate or layer, using a mask for limiting the areas where the jet impinges upon the surface, which mask has its surface on which the jet impinges coated with a layer preventing substantial mechanical stresses from being generated in the mask during the process by the jet powder particles, wherein the coating has a sticky surface.

5. A method of providing a plurality of cavities and/or apertures arranged in a pattern in a plate or layer of non-metallic material, in which the pattern is made by means of the following steps:

producing at least one jet of abrasive powder particles;

directing the jet onto a surface of the plate or layer;

limiting the areas where the jet impinges upon the surface;

performing a relative movement between the jet and the plate or layer, using a mask for limiting the areas where the jet impinges upon the surface, which mask has its surface on which the jet impinges coated with a protective layer preventing substantial mechanical stresses from being generated in the mask by the impact of the powder particles, the protective layer comprising a soft elastic lacquer, wherein the mask side to be coated is provided with an adhesive primer in advance of coating.

6. A method as claimed in claim 5, wherein the soft elastic lacquer is polyurethane-based.

7. A method as claimed in claim 5, wherein the soft elastic lacquer is epoxy-based.

8. A method as claimed in claim 5, wherein the soft elastic lacquer is sprayed on the surface of the mask before the jet of abrasive powder particles is directed onto the mask.

9. A method of providing a plurality of cavities and/or apertures arranged in a pattern in a plate or layer of non-metallic material, in which the pattern is made by means of the following steps:

producing at least one jet of abrasive powder particles;

directing the jet onto a surface of the plate or layer;

limiting the areas where the jet impinges upon the surface;

performing a relative movement between the jet and the plate or layer, using a mask for limiting the areas where the jet impinges upon the surface, which mask has its surface on which the jet impinges coated with a protective layer preventing substantial mechanical stresses from being generated in the mask by the impact of the powder particles, the protective layer having a sticky surface on which powder particles stick and thus contribute to the protecting effect of the protective layer.

10. A method as claimed in claim 9, wherein the sticky surface is provided by coating the protective layer with a sticky substance.

11. A method as claimed in claim 9, wherein the mask side to be coated is provided with an adhesive primer in advance of coating.

* * * * *